United States Patent [19]

Owen

[11] Patent Number: 5,073,249

[45] Date of Patent: Dec. 17, 1991

[54] HEAVY OIL CATALYTIC CRACKING PROCESS AND APPARATUS

[75] Inventor: Hartley Owen, Belle Mead, N.J.

[73] Assignee: Mobil Oil Corporation, Fairfax, Va.

[21] Appl. No.: 439,753

[22] Filed: Nov. 21, 1989

[51] Int. Cl.[5] ..... C10G 9/16

[52] U.S. Cl. ..... 208/48 Q; 208/113; 208/100; 208/103; 208/348; 208/48 R

[58] Field of Search ..... 208/48 Q, 153, 127

[56] References Cited

U.S. PATENT DOCUMENTS

| | | | |
|---|---|---|---|
| 2,791,549 | 5/1957 | Jahnig | 208/48 Q |
| 2,793,173 | 5/1957 | Fritz | 208/48 Q |
| 2,852,444 | 9/1958 | Spencer | 196/55 |
| 2,889,265 | 6/1959 | Borey et al. | 208/48 Q |
| 2,906,695 | 9/1959 | Boston | 208/48 Q |
| 3,238,271 | 3/1966 | Nonnenmacher et al. | 585/635 |
| 3,338,821 | 8/1967 | Moyer et al. | 208/48 Q |
| 3,547,805 | 10/1967 | Mitchell | 208/48 Q |
| 3,574,781 | 2/1968 | Racine et al. | 208/48 Q |
| 3,597,494 | 8/1971 | Bigache et al. | 208/48 Q |
| 3,718,708 | 2/1973 | Ozawa et al. | 208/48 Q |
| 4,097,362 | 6/1978 | McKinney et al. | 208/57 |
| 4,121,908 | 10/1978 | Raab et al. | 208/48 Q |
| 4,234,388 | 11/1980 | Mallan et al. | 208/48 Q |
| 4,351,275 | 9/1982 | Bhojwani et al. | 208/48 Q |
| 4,356,151 | 10/1982 | Woebcke et al. | 208/48 Q |
| 4,426,359 | 1/1984 | Wolbcke et al. | 208/48 Q |
| 4,444,697 | 4/1984 | Guter et al. | 208/48 Q |
| 4,446,003 | 5/1984 | Burton et al. | 208/48 Q |
| 4,764,268 | 8/1988 | Lane | 208/48 Q |
| 4,822,761 | 4/1989 | Walters et al. | 502/38 |

FOREIGN PATENT DOCUMENTS

| | | | |
|---|---|---|---|
| 48-23406 | 7/1973 | Japan | 208/48 Q |

OTHER PUBLICATIONS

"Troubleshooting Process Operations", 2nd Edition, Norman P. Lieberman, pp. 140–146.

*Primary Examiner*—Helane E. Myers

*Attorney, Agent, or Firm*—A. J. McKillop; C. J. Speciale; Richard D. Stone

[57] ABSTRACT

A process and apparatus for fluidized catalytic cracking of heavy oils is disclosed. The long transfer line connecting the catalytic cracking reactor to the main fractionator is modified to include a cooling means, such as a quench drum or a heat exchanger. Cooling hot cracked products from the FCC reactor upstream of the main fractionator prevents thermal cracking in the transfer line, improves yields, and permits higher catalytic cracking reactor temperatures.

11 Claims, 2 Drawing Sheets

HEAVY OIL CATALYTIC CRACKING PROCESS AND APPARATUS

BACKGROUND OF THE INVENTION

1. Field of the Invention

The field of the invention is catalytic cracking of heavy hydrocarbon feeds using a moving or fluidized bed of cracking catalyst.

2. Description of Related Art

Catalytic cracking is the backbone of many refineries. It converts heavy feeds into lighter products by catalytically cracking large molecules into smaller molecules. Catalytic cracking operates at low pressures, without hydrogen addition, in contrast to hydrocracking, which operates at high hydrogen partial pressures. Catalytic cracking is inherently safe as it operates with very little oil actually in inventory during the cracking process.

There are two main variants of the catalytic cracking process: moving bed and the far more popular and efficient fluidized bed process.

In the fluidized catalytic cracking (FCC) process, catalyst, having a particle size and color resembling table salt and pepper, circulates between a cracking reactor and a catalyst regenerator. In the reactor, hydrocarbon feed contacts a source of hot, regenerated catalyst. The hot catalyst vaporizes and cracks the feed at 425C-600C, usually 460C-560C. The cracking reaction deposits carbonaceous hydrocarbons or coke on the catalyst, thereby deactivating the catalyst. The cracked products are separated from the coked catalyst. The coked catalyst is stripped of volatiles, usually with steam, in a catalyst stripper and the stripped catalyst is then regenerated. The catalyst regenerator burns coke from the catalyst with oxygen containing gas, usually air. Decoking restores catalyst activity and simultaneously heats the catalyst to, e.g., 500C-900C, usually 600C-750C. This heated catalyst is recycled to the cracking reactor to crack more fresh feed. Flue gas formed by burning coke in the regenerator may be treated for removal of particulates and for conversion of carbon monoxide, after which the flue gas is normally discharged into the atmosphere.

Catalytic cracking is endothermic, it consumes heat. The heat for cracking is supplied at first by the hot regenerated catalyst from the regenerator. Ultimately, it is the feed which supplies the heat needed to crack the feed. Some of the feed deposits as coke on the catalyst, and the burning of this coke generates heat in the regenerator, which is recycled to the reactor in the form of hot catalyst.

Catalytic cracking has undergone progressive development since the 40s. The trend of development of the fluid catalytic cracking (FCC) process has been to all riser cracking and use of zeolite catalysts.

Zeolite-containing catalysts having high activity and selectivity are now used in most FCC units. These catalysts work best when coke on the catalyst after regeneration is less than 0.1 wt %, and preferably less than 0.05 wt %.

To regenerate FCC catalysts to these low residual carbon levels, and to burn CO completely to $CO_2$ within the regenerator (to conserve heat and minimize air pollution) many FCC operators add a CO combustion promoter metal to the catalyst or to the regenerator.

U.S. Pat. Nos. 4,072,600 and 4,093,535, which are incorporated by reference, teach use of combustion-promoting metals such as Pt, Pd, Ir, Rh, Os, Ru and Re in cracking catalysts in concentrations of 0.01 to 50 ppm, based on total catalyst inventory.

Modern, zeolite based catalysts are so active that the heavy hydrocarbon feed can be cracked to lighter, more valuable products in much less time. Instead of dense bed cracking, with a hydrocarbon residence time of 40-100 seconds, much less contact time is needed. The desired conversion of feed can now be achieved in much less time, and more selectively, in a dilute phase, riser reactor.

Riser cracking is more selective than dense bed cracking. Refiners maximized riser cracking benefits, but in so doing induced, inadvertently, a significant amount of thermal cracking. Thermal cracking is not as selective as either riser cracking or dense bed cracking, and most refiners would deny doing any thermal cracking, while building and operating FCC units with all riser cracking which also did a significant amount of thermal cracking.

Thermal cracking was caused by the use of upflow riser reactors, which discharged cracked products more than a 100 feet up, and use of product fractionation facilities which charged the hot vapors from the FCC unit to the bottom of the main column. The transfer lines to connect the FCC kept getting longer, and the material exiting the riser reactor kept getting hotter, and the combination caused thermal cracking.

The reasons for high risers in FCC, and for adding hot vapor to the bottom of the FCC main column will be briefly reviewed. After this, some other work on minimizing thermal cracking in riser cracking FCC units will be reviewed.

Risers are tall because of high vapor velocities and residence time. The FCC riser operates in dilute phase flow. There is better distribution of catalyst across the riser when vapor velocities are fairly high. Many FCC riser reactors now operate with vapor velocities on the order of 40-100 feet per second. To achieve enough residence time in the riser, the riser must be very tall. For a 2 second hydrocarbon residence time, the riser must be at least 100 feet long with a 50 fps vapor velocity. There usually must be additional space provided at the base of the riser reactor to add catalyst and more space for feed nozzles. The cracked vapor products exit the riser and enter a reactor vessel, at an elevation more than 100 feet in the air, for separation of spent catalyst from cracked products, usually in one or more stages of cyclone separation. The cracked products are eventually discharged, usually up, from the separation section, usually at an elevation well above the top of the riser, and charged to the base of the main column.

Hot vapors from the FCC unit are charged to the base of the main column for several reasons, but primarily so that the hot vapors may be used to heat the column. Another reason is that the hot vapors always contain some catalyst and catalyst fines, which are never completely removed in the FCC reactor, despite the use of multiple stages of cyclone separators. Adding the fines laden vapor to the bottom of the main column at least minimizes amount of fines that must circulate through the column. The fines are largely confined to the very base of the column. The lower trays or packing of the main column are designed to tolerate the fines, as with the using of sloping trays that permits fines to drain or be swept from a tray without clogging the tray.

The combination of high temperatures in the riser reactor, many times exceeding 1000 F, a tall riser reactor, and a bottom fed main column, give enough residence time to cause a significant amount of thermal cracking to occur in the transfer line between the riser reactor and fractionator.

As the process and catalyst improved, refiners attempted to use the process to upgrade a wider range of feedstocks, in particular, feedstocks that were heavier.

These heavier, dirtier feeds have placed a growing demand on the reactor and on the regenerator. Processing resids exacerbated existing problem areas in the riser reactor, namely feed vaporization, catalyst oil contact, accommodation of large molar volumes in the riser, and coking in the transfer line from the reactor to the main fractionator. Each of these problem areas will be briefly discussed.

Feed vaporization is a severe problem with heavy feeds such as resids. The heavy feeds are viscous and difficult to preheat in conventional preheaters. Most of the heating and vaporization of these feeds occurs in the base of the riser reactor, where feed contacts hot, regenerated catalyst. Because of the high boiling point, and high viscosity, of heavy feed, feed vaporization takes longer in the riser, and much of the riser length is wasted in simply vaporizing feed. Multiple feed nozzles, fog forming nozzles, etc., all help some, but most refiners simply add more atomizing steam. Use of large amounts of atomizing steam helps produce smaller sized feed droplets in the riser, and these smaller sized drops are more readily vaporized. With some resids, operation with 3–5 wt % steam, or even more, approaching in some instances 5–10 wt % of the resid feed, is needed to get adequate atomization of resid. All this steam helps vaporize the feed, but wastes energy because the steam is heated and later condensed. It also adds a lot of moles of material to the riser. The volume of steam approaches that of the volume of the vaporized resid in the base of the riser. This means that up to half of the riser volume is devoted to steaming (and deactivating) the catalyst, rather than cracking the feed.

In many FCC units better feed vaporization is achieved by using a higher temperature in the base of the riser reactor, and quenching the middle of the riser or the riser outlet.

Catalyst/oil contact is concerned with how efficiently the vaporized feed contacts catalyst in the riser. If feed vaporization and initial contacting of catalyst and oil is efficient, then catalyst/oil contact will tend to be efficient in the rest of the riser as well. High vapor velocities, and more turbulent flow, promote better contact of catalyst and oil in the riser. High superficial vapor velocities in the riser mean that longer risers are required to achieve the residence time needed to attain a given conversion of heavy feed to lighter components.

Large molar volumes are sometimes a problem when processing resids. This is because the heavy feeds, with an extremely high molecular weight, occupy little volume when first vaporized, but rapidly crack to produce a large molar expansion. Large amounts of vaporization steam add to the volume of material that must be processed in the riser, and addition of quench material to the riser, or to the riser outlet, all increase the volume of material that must be handled by the main column. More volume does not usually translate into reduced residence time in the transfer line connecting the cracked vapor outlet near the top of the FCC riser to the base of the main column. This is because refiners usually use vapor velocities in large vapor lines of 80 to 120 feet per second. These vapor velocities are used for several reasons, but primarily to control erosion and limit pressure drop. Erosion is a problem because of the presence of catalyst fines. Pressure drop is a problem, because it takes a lot of energy to transfer large volumes of material through a large pressure drop. High pressure drops in this transfer line, the line to the main column, would also increase the FCC reactor pressure, which is undesirable from a yield standpoint, and decrease the main column pressure which increases the load on the wet gas compressor associated with the main column.

Coking in the transfer lines connecting the FCC reactor vapor outlet with the main column refers to coke formation in this transfer line. FCC operators have long known that "dead spaces" in a line could lead to coke formation. Coke formation is a frequently encountered problem in the "dome" or large weldcap which forms the top of the vessel housing the riser reactor cyclones If oil at high temperature is allowed to remain stagnant for a long time, it will slowly form coke. For this reason refiners have routinely added a small amount of "dome steam", typically 500 #/hr, to prevent formation of coke in the dome of an FCC unit. Coking in the transfer line is somewhat related, in that coke will form in stagnant or dead areas of the transfer line. Coke will also form if there are cool spots in the transfer line. The cool spots allow some of the heaviest material in the reactor effluent vapor to condense. These heavy materials, some of which may be entrained asphaltenic materials, will form coke if allowed to remain for a long time in the transfer line. Thus refiners have tried to insulate the transfer line to the main column, not only to prevent heat loss to the atmosphere, but also to prevent coking in this line. The problem of coke formation gets more severe with either an increase in reactor/transfer line temperatures, or with a decrease in feed quality so that it contains more heavier materials.

Although great strides have been taken to improve many parts of the FCC process, such as better regenerators, better catalyst strippers, and better catalysts, the process has not been able to realize its full potential, especially with heavy feedstocks including non-distillable materials.

These trends, to high temperatures and high vapor velocity in the riser, and tall risers, all improved the cracking process and provided better yields of cracked products. These trends allowed FCC units to process significantly heavier feeds. These trends also caused unselective thermal cracking of the valuable cracked products, and increased the amount of energy needed to move cracked products from the reactor to the main column.

I examined the work that others had done, and realized that it was time for a new approach. I wanted the benefits of short residence time riser cracking, without the unselective thermal cracking, coke formation in transfer lines, and excessive energy consumption associated with the conventional way of recovering cracked products from a FCC riser reactor vapors.

I wanted the option to uncouple, to some extent, the main column from the FCC reactor. This could permit a lower pressure in the FCC riser reactor, and improve the efficiency of the FCC main column.

BRIEF SUMMARY OF THE INVENTION

Accordingly, the present invention provides in a fluidized catalytic cracking process wherein a heavy hydrocarbon feed comprising hydrocarbons having a boiling point above about 650 F is catalytically cracked to cracked products comprising the steps of catalytically cracking said feed in a catalytic cracking zone operating at catalytic cracking conditions by contacting said feed with a supply of hot regenerated cracking catalyst to produce a cracking zone effluent mixture having an effluent temperature and comprising cracked products and spent cracking catalyst containing coke and strippable hydrocarbons; separating said cracking zone effluent mixture into a cracked product vapor phase having an elevated temperature and spent catalyst; stripping and regenerating said spent catalyst to produce a supply of hot, regenerated catalyst which is recycled to crack heavy feed; removing said cracked product vapor phase via a transfer line and charging said cracked product vapor to a main fractionator, and wherein cracked product vapor has a residence time in said transfer line and a temperature in said transfer line which causes thermal cracking of cracked products; the improvement comprising: cooling the hot cracked vapor phase after separation from spent cracking catalyst to reduce the amount of thermal cracking in said transfer line by at least 30%.

In another embodiment, the present invention provides a fluidized catalytic cracking process for catalytic cracking of a feed comprising hydrocarbons having a boiling point above about 650 F comprising: catalytically cracking said feed in a catalytic cracking zone riser reactor having a height in excess of 30 meters at catalytic cracking conditions by contacting said feed with a source of hot regenerated cracking catalyst to produce a riser effluent mixture having an effluent temperature above 1000 F and comprising cracked products and spent cracking catalyst containing coke and strippable hydrocarbons; separating within a vessel said cracking zone effluent mixture into a cracked product vapor phase having a temperature above 1000 F and a spent catalyst rich phase; stripping and regenerating said spent catalyst to produce regenerated catalyst which is recycled to crack heavy feed; removing said cracked product vapor from said vessel via a vapor line connective with a quench zone; quenching the hot cracked vapor product with a quench liquid said quench zone to reduce the temperature of the cracked product vapor below 800 F and produce a quenched vapor product; and fractionating the quenched vapor product to recover catalytically cracked products.

In another embodiment, the present invention provides an apparatus for the fluidized catalytic cracking of a heavy hydrocarbon feed comprising hydrocarbons having a boiling point above about 650 F to lighter products by contacting said feed with catalytic cracking catalyst comprising: a catalytic cracking riser reactor means having an inlet in a lower portion of the riser connective with a source of said feed and with a source of hot regenerated catalyst and having an outlet at an upper portion of the riser for discharging a cracking zone effluent mixture comprising cracked products and spent cracking catalyst; a separation means within a vessel containing the riser reactor outlet for separating said cracking zone effluent mixture into a cracked product vapor phase which is removed from said vessel via a vessel outlet and a spent catalyst rich phase; means for stripping and regenerating the spent catalyst to produce regenerated catalyst and means for recycling regenerated catalyst to the base of the riser reactor; a transfer line connective with the vessel outlet for transfer of cracked vapor to a main fractionator means for fractionation and recovery of cracked products; a cooling means connective with said transfer line and intermediate the vessel outlet and the main fractionator.

DETAILED DESCRIPTION

Figure 1:
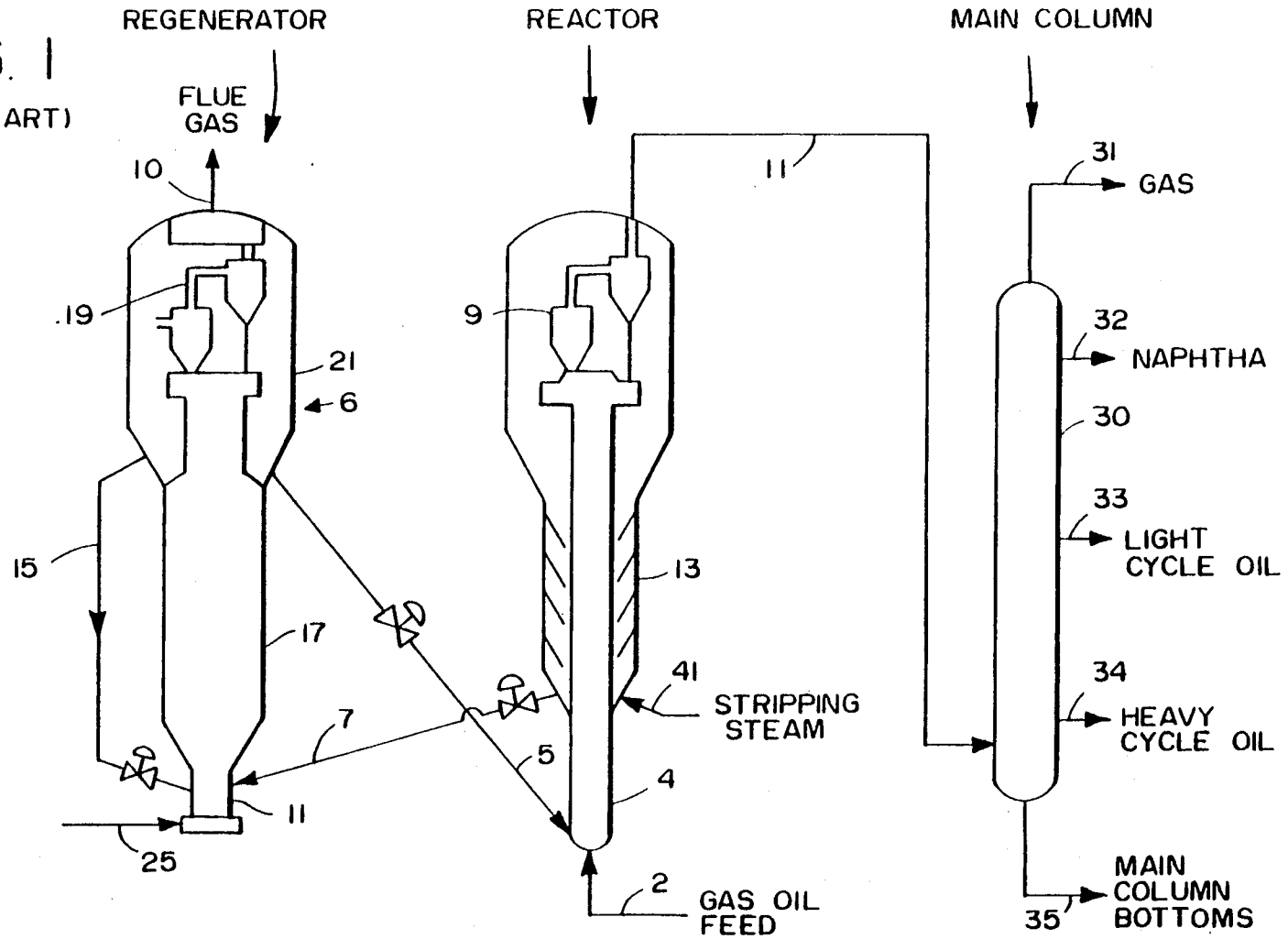
FIG. 1 (PRIOR ART)
FIG. 1 (prior art) is a simplified schematic view of an FCC unit of the prior art, with all riser cracking, and a transfer line from the riser reactor to the main column.

The present invention can be better understood by reviewing it in conjunction with the conventional way of operating an all riser cracking FCC unit. FIG. 1 illustrates a fluid catalytic cracking system of the prior art. It is a simplified version of FIG. 1 or U.S. Pat. No. 4,421,636, which is incorporated herein by reference.

A heavy feed, typically a gas oil boiling range material, is charged via line 2 to the lower end of a riser cracking FCC reactor 4. Hot regenerated catalyst is added via conduit 5 to the riser. Preferably, some atomizing steam is added, by means not shown, to the base of the riser, usually with the feed. With heavier feeds, e.g. , a resid, 2–10 wt. % steam may be used. A hydrocarbon-catalyst mixture rises as a generally dilute phase through riser 4. Cracked products and coked catalyst are discharged from the riser. Cracked products pass through two stages of cyclone separation shown generally as 9 in the figure.

The riser 4 top temperature, which usually is close to the temperature in conduit 11, ranges between about 480 and 615 C (900 and 1150 F), and preferably between about 538 and 595 C (1000 and 1050 F). The riser top temperature is usually controlled by adjusting the catalyst to oil ratio in riser 4 or by varying feed preheat.

Cracked products are removed from the FCC reactor via transfer line 11 and charged to the base of the main column 30. In some refineries, this column would be called the Syncrude column, because the catalytic cracking process has created a material with a broad boiling range, something like a synthetic crude oil. The main column 30 recovers various product fractions, from a heavy material such as main column bottoms, withdrawn via line 35 to normally gaseous materials, such as the vapor stream removed overhead via line 31 from the top of the column. Intermediate fractions include a heavy cycle oil fraction in line 34, a light cycle oil in line 33, and a heavy naphtha fraction in line 32.

Cyclones 9 separate most of the catalyst from the cracked products and discharges this catalyst down via diplegs to a stripping zone 13 located in a lower portion of the FCC reactor. Stripping steam is added via line 41 to recover adsorbed and/or entrained hydrocarbons from catalyst. Stripped catalyst is removed via line 7 and charged to a high efficiency regenerator 6. A relatively short riser-mixer section [11] is used to mix spent catalyst from line 7 with hot, regenerated catalyst from line 15 and combustion air added via line 25. The riser mixer discharges into coke combustor 17. Regenerated catalyst is discharged from an upper portion of the dilute phase transport riser above the coke combustor. Hot regenerated catalyst collects as a dense phase fluidized bed, and some of it is recycled via line 15 to the riser mixer, while some is recycled via line 5 to crack the fresh feed in the riser reactor 4. Several stages of cyclone separation are used to separate flue gas, removed via line 10.

Thermal cracking degrades the cracked product removed via line 11. The average residence time in the transfer line between the FCC reactor outlet and the main column is usually in excess of 5 seconds, although some units operate with a vapor residence time in excess of 10 seconds.

The temperature in this line is usually close to the riser outlet temperature. The combination of time and temperature is enough to cause a significant amount of unselective, and unwanted, thermal cracking upstream of the main column.

There is an additional problem with the prior art design when it is used to crack feeds containing more than 10% non-distillable feeds, or when the feed contains more than 3 to 5 wt % CCR. This additional problem is coke formation in the transfer line. It is somewhat related to thermal cracking, but becomes a severe problem only when heavier feedstocks are being cracked. It may be due to carryover or uncracked asphaltenic material, or thermal degradation or polymerization of large aromatic molecules into coke or coke precursors.

Polymerization, or coking in the transfer line need not involve a large fraction of the cracked product to cause a problem with product purity or plugging of the transfer line or the main column. Phrased another way, coking in the unit could shut the unit down, but need not be noticeable in yields. Thermal cracking in the transfer line will cause a significant yield loss, but will not automatically cause coking or plugging of the transfer line. Fortunately both problems are overcome by the process of the present invention, which will be discussed in conjunction with FIG. 2.

Figure 2:
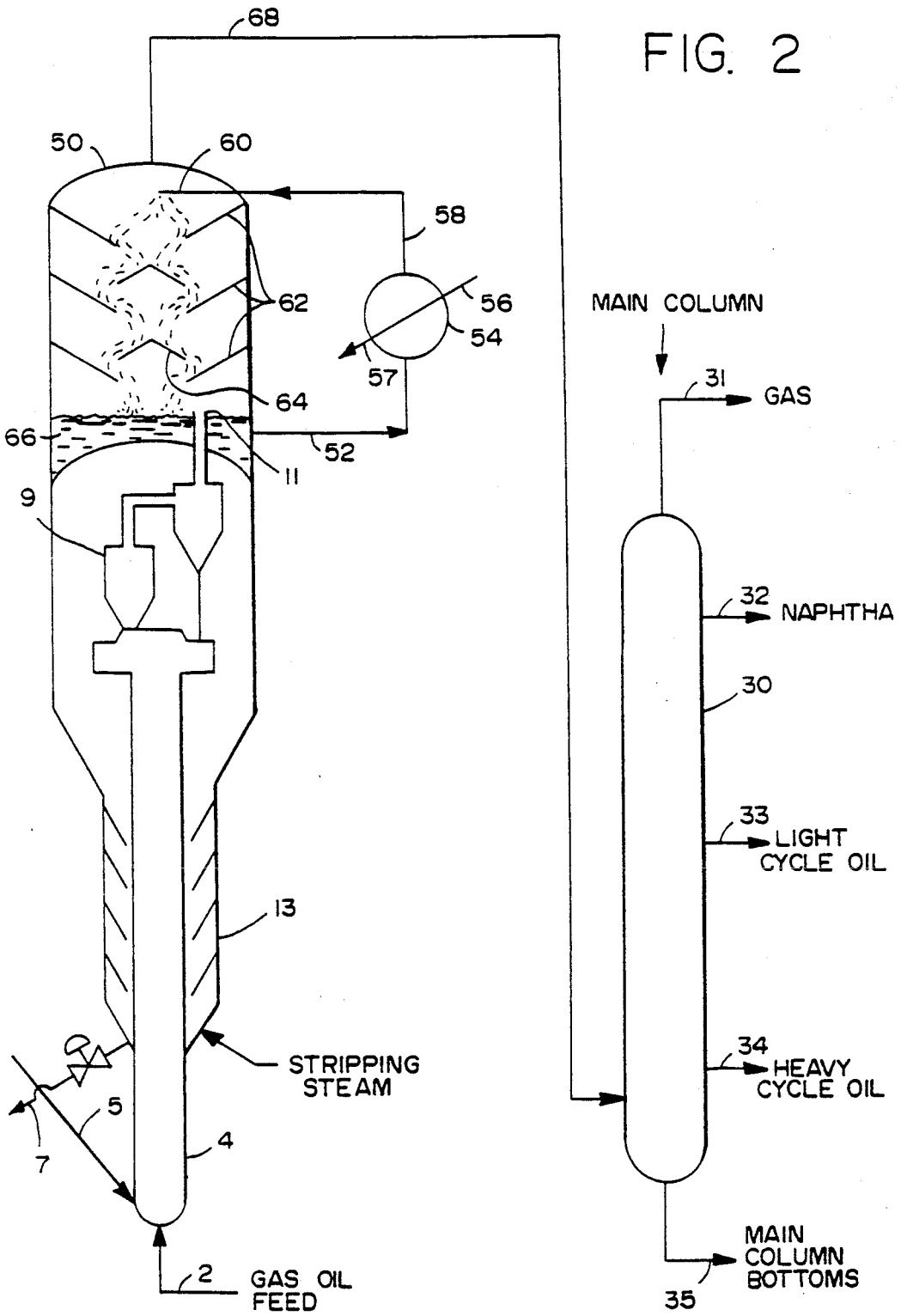
FIG. 2 is a simplified schematic view of an FCC unit of the invention, with a quench drum above the riser outlet.

FIG. 2 shows one embodiment of the present invention. Many of the elements in FIG. 2 are identical to those in FIG. 1, and like elements, such as main column 30, have like reference numerals in both figures.

As in the FIG. 1 embodiment, a heavy feed, preferably containing more than 10% residual or non-distillable material, is cracked in riser cracker 4. Cracked products are discharged from the riser, pass through two stages of cyclone separation 9 and are discharged via line 11 from the FCC reactor.

The cracked vapors are immediately cooled in quench drum 50, which is mounted on top of the FCC reactor section. Hot cracked hydrocarbons in line 11 contact a heavy quench liquid which is recirculated in a pumparound circuit. A heavy liquid, such as slurry oil from the main column, is removed from the bottom of the quench drum via line 52, and is pumped, using pumps not shown, through cooler 54. Cooler 54 heat exchanges hot liquid with a cooler heat exchange fluid, added relatively cool via line 56 and removed relatively warmer via line 57. Cooler 54 can comprise multiple heat exchangers, in series or in parallel. Preferably, the high grade heat in hot cracked vapors is used to generate high pressure steam for use in the refinery, or reboil a fractionator, such as the FCC gasoline debutanizer column. One or more fin fan coolers can be used to reject some heat to the air. The coolant is not important. What is important is that some heat sink be available to cool the liquid in the pumparound circuit.

The cooled liquid is removed from heat exchanger 54 via line 58 and recycled to the quench drum 50 via outlet 60. Preferably a spray nozzle, or liquid distribution system, is used to aid in distributing liquid across the cross-sectional area of quench drum 50. The liquid passes down via multiple outer plates 62 and inner plates 64 which together define a torturous path for vapor flow. Quench liquid accumulates in a pool 66 in the base of the quench drum. Hot vapors from the reactor pass up the quench drum and contact descending liquid. This rapidly and completely quenches the cracked vapor to any desired temperature. The quenched cracked vapor is charged via line 68 to the main column.

Although slanted splash plates are shown in the figure, there are many other vapor liquid contacting means which can be used. A single, large, open chamber with an efficient liquid distribution system, such as a spray nozzle, will quench hot vapors. Packing materials, such as any conventional distillation column packing material, may be used. The conditions in the quench drum are similar to those existing in the base of the main fractionator, and the same methods used to achieve good vapor/liquid contact and the presence of fines can be used herein.

There will be large amounts of catalyst fines which collect in the quench liquid. Some provision for fines removal should be provided. Although filters, settling tanks and similar equipment can be used, it will be preferred in many refineries to simply drag or remove a portion of this quench liquid and send it to the main column, which is already designed to accommodate this amount of fines production.

Now that the invention has been briefly reviewed in conjunction with the review of FIG. 2, a more detailed discussion of feed, catalyst, and equipment will be presented.

QUENCH DRUM

A quench drum mounted on top of or near by the riser reactor outlet is a preferred way of eliminating thermal cracking in the transfer line to the main fractionator.

The design of a suitable quench drum is conventional and well within the skill of those skilled in the FCC arts. It will look much like the base of present day main fractionators, which in effect quench the hot, cracked product vapor during the course of fractionation.

The quench drum is preferably operated fairly near the reactor outlet, so that the residence time of high temperature vapor will be greatly minimized. Where site constraints prevent close coupling of the quench drum to the cracked vapor outlet, it will be possible to achieve many of the benefits of the present invention with a quench drum which is somewhat remote from the reactor vapor outlet, or more strictly speaking, the vapor outlet from the vessel wherein spent catalyst and cracked products are separated.

The quench drum location, and the quench drum temperature are preferably selected to minimize thermal cracking, as measured by ERT or Equivalent Reaction Time at 800 F, by at least 30%, and more preferably by at least 50% and most preferably by at least 70%.

The quench drum can operate solely as a quenching means, and achieve little or no fractionation or can be operated to achieve a modest amount of fractionation.

In a pure quench mode, with essentially no fractionation achieved, all the cracked vapor product entering the quench drum can be discharged as cooled material in the vapor form. To accomplish this the quench drum can be fed hot cracked vapor via an inlet at the bottom of the quench drum, and a refractory, high boiling quench liquid admitted via a quench liquid inlet at the top of the quench drum. The refractory quench liquid, e.g., a slurry oil, can be cooled by an external heat exchanger, or by reboiling a distillation column, or by passage through a fin fan cooler, to reject heat to the air.

Some fractionation or separation of cracked vapor into lighter and heavier products can, and usually will be achieved when the hot vapors are quenched enough to condense. This will usually be the case. Fractionation efficiency can be improved by providing multiple trays, or a greater depth of packing material in the quench drum. Fractionation efficiency will further improve by adding the hot cracked vapor feed to the quench drum at a point where the feed most closely matches the composition in the quench drum. This will usually be somewhat above the base of the quench drum, when packing is used, or at least above one theoretical tray when distillation trays are used. It is not the aim of the present invention to achieve a very efficient fractionation in the quench drum, and it usually will cost too much to put much of a fractionator above the FCC reactor. Rather it is the goal to quench the hot vapor, and take advantage of the limited resolution of very heavy liquid from lighter products that can be achieved for very little cost as an incidental benefit to quenching. In this mode, some fractionation is achieved, and a heavy liquid product will be withdrawn from the quench drum.

In some units it may be preferred to operate with a relatively light quench liquid such as a naphtha or light cycle oil fraction, which is completely vaporized in the quench drum. Although the quench liquid is vaporized and removed, a heavy liquid product fraction can still be condensed in the quench drum vaporized in the quench drum.

A significant amount of fractionation can also be achieved in the quench drum by including sufficient packing, or sufficient trays to allow fractionation to occur. Preferably at least two theoretical trays of vapor liquid separation are provided, or the equivalent in packing material.

In a preferred embodiment, the quench zone will be operated to remove most or all of the high boiling cracked product, typically the 750 F+boiling range material. This can be done using a relatively heavy quench liquid, comprising 750 F+material, or with a lighter quench liquid which might be totally vaporizable at the quench conditions used. Use of light cycle oil, or a naphtha fraction allows a significant amount of heat to be taken out of the system in the quench drum (by vaporizing the quench liquid) without loading up the upper portions of the distillation column with water vapor. Where the main column permits, and where production of sour water is not a problem, water or low pressure steam may be used as a quench fluid.

In another embodiment, a quench zone is operated to condense much of the heavy boiling hydrocarbon in the cracked product, to produce a heavy liquid product from the quench zone as discussed above. This quench zone liquid effluent can then be sent to a stripper, preferably a steam stripper, for removal of light ends. The use of the quench zone to make a rough separation of heavy from light products, and a stripper to clean up the heavy product and avoid loss of valuable light products in the heavy liquid rejected by the quench zone, minimizes size and cost of the quench drum while maximizing recovery of valuable liquid products. This embodiment also significantly reduces, and may even eliminate, the amount of heavy liquid that must be processed in the main column. Preferably the stripper operates at a lower pressure than the quench zone. This reduced pressure operation increases the effectiveness of any stripping medium, such as steam, added to the stripping column.

It may also be beneficial in some instances to use two quench liquids, a primary quench and a secondary quench. When two quench liquids are used, and added to the quench column at different elevations thereof, the properties of the quench liquid can be fine tuned to meet the demands of the quenching zone. Preferably the quench liquid having the highest boiling range is introduced at the base of the quench column, while the quench liquid having a lower boiling range is added higher up in the column, preferably at least one theoretical tray higher. This will improve the efficiency of the quench zone fractionation as compared to operation with a single quench liquid added at multiple points in the quench zone.

Although use of a liquid quench medium is preferred, all or a portion of the quenching may be done via indirect heat exchange. In this way much of the high grade heat contained in the cracked vapor stream can be converted into high pressure steam for use in power generation, or for high temperature heating in the refinery. Fin fan coolers can simply reject the heat to the air, but this will waste some high grade energy. Conventional heat exchange means may be used to transfer heat from the hot cracked product stream to other refinery streams.

FCC FEED

Any conventional FCC feed can be used. The process of the present invention is especially useful for processing difficult charge stocks, those with high levels of CCR material, exceeding 2, 3, 5 and even 10 wt % CCR.

The feeds may range from the typical, such as petroleum distillates or residual stocks, either virgin or partially refined, to the atypical, such as coal oils and shale oils. The feed frequently will contain recycled hydrocarbons, such as light and heavy cycle oils which have already been subjected to cracking.

Preferred feeds are gas oils, vacuum gas oils, atmospheric resids, and vacuum resids. The present invention is most useful with feeds having an initial boiling point above about 650 F.

The most uplift in value of the feed will occur when at least 10 wt %, or 50 wt % or even more of the feed has a boiling point above about 1000 F, or is considered non-distillable.

FCC CATALYST

Any commercially available FCC catalyst may be used. The catalyst can be 100% amorphous, but preferably includes some zeolite in a porous refractory matrix such as silica-alumina, clay, or the like. The zeolite is usually 5–40 wt. % of the catalyst, with the rest being matrix. Conventional zeolites include X and Y zeolites, with ultra stable, or relatively high silica Y zeolites being preferred. Dealuminized Y (DEAL Y) and ultrahydrophobic Y (UHP Y) zeolites may be used. The zeolites may be stabilized with Rare Earths, e.g., 0.1 to 10 Wt % RE.

Relatively high silica zeolite containing catalysts are preferred for use in the present invention. They withstand the high temperatures usually associated with complete combustion of CO to CO2 within the FCC regenerator.

The catalyst inventory may also contain one or more additives, either present as separate additive particles, or mixed in with each particle of the cracking catalyst. Additives can be added to enhance octane (shape selective zeolites, i.e., those having a Constraint Index of 1-12, and typified by ZSM-5, and other materials having a similar crystal structure), adsorb SOX (alumina), remove Ni and V (Mg and Ca oxides).

Good additives for removal of SOx are available from several catalyst suppliers, such as Davison's "R" or Katalistiks International, Inc.'s "DeSox."

CO combustion additives are available from most FCC catalyst vendors.

The FCC catalyst composition, per se, forms no part of the present invention.

FCC REACTOR CONDITIONS

Conventional riser cracking conditions may be used. Typical riser cracking reaction conditions include catalyst/oil ratios of 0.5:1 to 15:1 and preferably 3:1 to 8:1, and a catalyst contact time of 0.1-50 seconds, and preferably 0.5 to 5 seconds, and most preferably about 0.75 to 4 seconds, and riser top temperatures of 900 to about 1050 F.

The process of the present invention tolerates and encourages use of somewhat unconventional reactor conditions. Riser top temperatures of 1100 F, 1150 F, 1200 or even higher can be tolerated in the process of the present invention, and are preferred when the feed is heavy, and contains 10% or more of resid. Unusually short riser residence times are possible at such high temperatures, so riser hydrocarbon residence times of 0.1 to 5 seconds may be used., e.g., 0.2 to 2 seconds.

It is preferred, but not essential, to use an atomizing feed mixing nozzle in the base of the riser reactor, such as ones available from Bete Fog. More details of use of such a nozzle in FCC processing is disclosed in U.S. Ser. No. 229,670, which is incorporated herein by reference.

It is preferred, but not essential, to have a riser catalyst acceleration zone in the base of the riser.

It is preferred, but not essential, to have the riser reactor discharge into a closed cyclone system for rapid and efficient separation of cracked products from spent catalyst. A preferred closed cyclone system is disclosed in Haddad et al. U.S. Pat. No. 4,502,947.

It is preferred but not essential, to rapidly strip the catalyst, immediately after it exits the riser, and upstream of the conventional catalyst stripper. Stripper cyclones disclosed in U.S. Pat. No. 4,173,527, Schatz and Heffley, which is incorporated herein by reference, may be used.

It is preferred, but not essential, to use a hot catalyst stripper. Hot strippers heat spent catalyst by adding some hot, regenerated catalyst to spent catalyst. Suitable hot stripper designs are shown in Owen et al U.S. Pat. No. 3,821,103, which is incorporated herein by reference.

If hot stripping is used, a catalyst cooler may be used to cool the heated catalyst before it is sent to the catalyst regenerator. A preferred hot stripped and catalyst cooler is shown in Owen U.S. Pat. No. 4,820,404, which is incorporated herein by reference.

The FCC reactor and stripper conditions, per se, can be conventional. In many refineries, the existing reactor and stripper can be left untouched, and the unit modified by adding quench drum or other cooling means intermediate the vapor outlet from the reactor section and the main column.

CATALYST REGENERATION

The process and apparatus of the present invention can use conventional FCC regenerators.

Preferably a high efficiency regenerator, such as is shown in the Figures, is used. The essential elements of a high efficiency regenerator include a coke combustor, a dilute phase transport riser and a second dense bed. Preferably, a riser mixer is used. These regenerators are widely known and used.

The process and apparatus can also use conventional, single dense bed regenerators, or other designs, such as multi-stage regenerators, etc. The regenerator, per se, forms no part of the present invention. In most units, the existing regenerator will be used to practice the present invention.

CO COMBUSTION PROMOTER

Use of a CO combustion promoter in the regenerator or combustion zone is not essential for the practice of the present invention, however, it is preferred. These materials are well-known.

U.S. Pat. Nos. 4,072,600 and 4,235,754, which are incorporated by reference, disclose operation of an FCC regenerator with minute quantities of a CO combustion promoter. From 0.01 to 100 ppm Pt metal or enough other metal to give the same CO oxidation, may be used with good results. Very good results are obtained with as little as 0.1 to 10 wt. ppm platinum present on the catalyst in the unit. Pt can be replaced by other metals, but usually more metal is then required. An amount of promoter which would give a CO oxidation activity equal to 0.3 to 3 wt. ppm of platinum is preferred.

Conventionally, refiners add CO combustion promoter to promote total or partial combustion of CO to CO2 within the FCC regenerator. More CO combustion promoter can be added without undue bad effect—the primary one being the waste of adding more CO combustion promoter than is needed to burn all the CO.

The present invention can operate with extremely small levels of CO combustion promoter while still achieving relatively complete CO combustion because the heavy feeds contemplated for use herein will usually deposit large amounts of coke on the catalyst, and give extremely high regenerator temperatures.

COMPARISON OF ESTIMATED YIELDS

The benefits of practicing the present invention can most easily be seen by comparing the yields obtainable in a conventional, prior art FCC unit versus an estimate of the yields obtainable in the same unit by adding a quench drum on top of the vessel containing the riser reactor outlet, cyclones, etc. The estimate is based on reducing the residence time of the hot, cracked vapor from the FCC reactor from 3 seconds to about 1 seconds.

The prior art unit estimate is based on yields obtainable in a conventional unit operating with a riser reactor, a high efficiency regenerator, and a conventional catalyst stripper.

The reactor conditions included:

Riser Top Temperature = 1000 F.
Riser Top Pressure = 32 psig

-continued

| Cat:Oil Ratio = 6.5:1 |
|---|

The feed had a specific gravity of 0.9075. Under these conditions, the unit achieved a 76.11 vol % conversion of feed.

The reactor discharged into a plenum having a volume of 2,154 cubic feet. The transfer line from the plenum to the main column a volume of 3,291 cubic feet, and was about 225 feet of 54" OD line.

The following yield estimate is presented in two parts. The first or base case is with no changes. The unit operates with a plenum chamber and conventional fractionator. The second case uses a quench drum on top of the reactor vessel, which still contains a plenum. The estimated benefits reflect a reduction in residence time of the hot cracked vapor from 3 seconds to 1 second.

REACTOR QUENCH DRUM STUDY

| CASE: | BASE | INVENTION |
|---|---|---|
| Conversion, Vol. % = | 76.11 | −0.10 |
| Gasoline Yield, Vol % | 58.12 | 0.16 |
| Gasoline Octane, RONCL | | −.09 |
| C2 and lighter wt % | 4.22 | −0.10 |
| C3 + C4 olefins,vol % | 15.06 | −0.15 |
| iC4 vol % | 5.32 | 0.01 |
| Light Fuel Oil | 18.27 | 0.16 |
| Heavy fuel Oil | 5.62 | −0.06 |
| G + D vol % | 76.39 | 0.32 |
| Coke (weight %) | 5.12 | 0 |
| Diene, ppm, approx. | 5000 | 1000 |
| Acetylenes, ppm | 500 | low |

This shows a decrease in thermal cracking. The ERT, or equivalent reaction time at 800 F has been greatly reduced. The residence time has been reduced from 3 seconds to one second or less using the quench drum of the invention. This reduction in thermal cracking increases yields of valuable liquid product, and improves product quality. There is a slight decrease in gasoline octane number because thermal cracking produces olefinic gasoline which has a good octane number. Thermal cracking also reduces yields of gasoline.

The process of the invention can produce even larger increases in G+D yields, or gasoline plus distillate yields, by about 0.80 vol % in new units. This can be done by eliminating the plenum chamber, and putting the quench drum close to the riser outlet. This could also be done in existing units, at relatively low capital cost.

In the commercially sized unit which was the basis for this study, processing 96.5 thousand barrels per day of feed, the practice of the present invention results in an increase of 309 barrels of gasoline and distillate product, by adding a quench drum.

In a new unit, with a quench drum next to the riser reactor vapor outlet, and the plenum eliminated, 772 more barrels of gasoline and distillate product could be obtained as compared to the conventional design with plenum and conventional fractionator, without a quench drum.

The invention is especially useful with all riser cracking FCC units. It would be beneficial even if no unusual feeds or conditions were being run in the FCC unit, i.e., there would be a small but definite reduction in thermal cracking in the transfer line as a result of use of a quench drum.

In addition to minimizing thermal cracking downstream of the FCC reactor, there are other benefits to the cracking process from the practice of the present invention. This is because the present invention permits higher temperatures to be used in the reactor and in the stripper.

Higher reactor temperatures are beneficial because vaporization of all feeds, and especially of resids, is favored by higher reactor temperatures. Much of the base of the riser is devoted to vaporizing the feed, and operating with higher riser temperatures allows more of the riser to be used for vapor phase cracking, rather than vaporization of liquid.

Higher riser top temperatures also allow more heat to be removed from the FCC unit with the cracked products. Less heat must be removed in the regenerator. This helps to keep the unit in heat balance. Recycle of a refractory stream, such as a slurry oil, or the pumparound oil, to the middle or outlet of the riser gives the refiner another way to remove heat from the system. Dumping a heat sink midway up the riser allows heat to be removed in vaporization of the heat sink material. This heat can be recovered in the form of high grade steam, by heat exchange at the reactor outlet. This heat can also be recovered in downstream fractionators.

Catalyst stripping will be slightly better at higher temperatures, so higher riser top temperatures will improve somewhat the stripping operation.

I claim:

1. A fluidized catalytic cracking process for catalytic cracking of a feed comprising hydrocarbons having a boiling point above about 750 F comprising:

a. catalytically cracking said feed in a catalytic cracking zone riser reactor having a height in excess of 30 meters at catalytic cracking conditions by contacting said feed with a source of hot regenerated cracking catalyst to produce a riser effluent mixture having an effluent temperature above 1000.F and comprising cracked products and spent cracking catalyst containing coke and strippable hydrocarbons;

b. separating within a vessel said cracking zone effluent mixture into a cracked product vapor phase including hydrocarbons having a boiling point above about 750 F and having a temperature above 1000 F and a spent catalyst rich phase;

c. stripping and regenerating said spent catalyst to produce regenerated catalyst which is recycled to crack heavy feed;

d. removing said cracked product vapor from said vessel via a vapor line connective with a quench zone;

e. quenching the hot cracked vapor product with a quench liquid in said quench zone to reduce the temperature of the cracked product vapor below 750 F and condense a majority of the cracked product hydrocarbons boiling above about 750 F to produce a quench zone heavy liquid stream comprising condensed catalytically cracked hydrocarbons having a boiling point above about 750 F and produce a separate quenched vapor product stream; and charging, via a vapor transfer line connective with a product fractionator, a quenched vapor stream consisting essentially of vapor and from which at least a majority of the cracked product hydrocarbons having a boiling point above about 750 F have been removed; and f. fractionating the quenched vapor product to recover catalytically cracked products.

2. The process of claim 1 wherein the quench liquid is an aromatic hydrocarbon which is recirculated from the quench means to an indirect heat exchange means to cool the quench liquid.

3. The process of claim 1 wherein the quench liquid effluent comprises condensed hydrocarbons having a boiling point above about 750 F and hydrocarbons having a boiling point below about 750 F and the quench liquid is stripped in a stripping zone to remove at least a portion of the hydrocarbons having a boiling point below about 750 F from the quench liquid.

4. The process of claim 3 wherein the stripping zone comprises a steam stripper.

5. The process of claim 3 wherein the quench zone operates at a pressure and the stripping zone operates at a reduced pressure relative to the quench zone pressure.

6. The process of claim 1 wherein the quench zone comprises vapor liquid contact means sufficient to provide at least two theoretical trays of vapor liquid distillation in the quench column.

7. The process of claim 6 wherein the quench column contains at least an upper and a lower point of quench liquid addition vertically spaced apart by at least one theoretical tray, and a primary quench liquid having a boiling range is introduced to the quench column at the lower point and a secondary quench liquid having a boiling range below that of the primary liquid is introduced to the quench column at the upper point of quench liquid addition.

8. The process of claim 1 wherein the quench column is above the vessel wherein separation of cracked product from spent catalyst occurs.

9. A fluidized catalytic cracking process for catalytic cracking of a feed comprising hydrocarbons having a boiling point above about 750 F comprising:

a. catalytically cracking said feed in a catalytic cracking zone riser reactor having a height in excess of 30 meters at catalytic cracking conditions by contacting said feed with a source of hot regenerated cracking catalyst to produce a riser effluent mixture comprising cracked products and spent cracking catalyst containing coke and strippable hydrocarbons;

b. separating within a vessel said cracking zone effluent mixture into a cracked product vapor phase including hydrocarbons having a boiling point above about 750 F spent catalyst rich phase;

c. stripping and regenerating said spent catalyst to produce regenerated catalyst which is recycled to crack heavy feed;

d. removing said cracked product vapor from said vessel via a vapor line connective with a quench zone;

e. quenching within about 1 second, in a fractionating quench column comprising vapor liquid fractionation means equivalent to at least two theoretical trays of vapor liquid fractionation, the hot cracked vapor product to reduce the temperature of the cracked product vapor below 750 F and fractionate the cracked vapor product to produce a quench zone heavy liquid product stream comprising condensed catalytically cracked hydrocarbons having a boiling point above about 750 F and a quenched vapor stream which is essentially free of liquid hydrocarbons having a boiling point above about 750 F; and f. fractionating in a fractionation means the quenched vapor product from the fractionating quench column to recover normally liquid hydrocarbon cracked products boiling below about 750 F.

10. The process of claim 9 wherein said fractionating quench means has a base and an upper region above said said base, and two quench liquids having differing boiling ranges are added to said fractionating quench means, a primary quench liquid having a relatively boiling range and a secondary quench liquid having a relatively low boiling range relative to the primary quench liquid, and wherein the primary quench liquid is introduced into the base of said quench means and said secondary quench is added to a point in said upper region region of said fractionating quench means at an elevation at least one theoretical tray above the point of introduction of said primary quench liquid.

11. The process of claim 9 wherein said fractionating quench means is above the vessel wherein separation of cracked product from spent catalyst occurs.

* * * * *